US008210832B2

(12) United States Patent
Katayama et al.

(10) Patent No.: US 8,210,832 B2
(45) Date of Patent: Jul. 3, 2012

(54) HERMETIC COMPRESSOR

(75) Inventors: Makoto Katayama, Kanagawa (JP); Kosuke Tsuboi, Kanagawa (JP)

(73) Assignee: Panasonic Corporation, Osaka (JP)

( * ) Notice: Subject to any disclaimer, the term of this patent is extended or adjusted under 35 U.S.C. 154(b) by 952 days.

(21) Appl. No.: 10/576,783

(22) PCT Filed: Dec. 9, 2005

(86) PCT No.: PCT/JP2005/023090

§ 371 (c)(1),
(2), (4) Date: Apr. 21, 2006

(87) PCT Pub. No.: WO2006/064890

PCT Pub. Date: Jun. 22, 2006

(65) Prior Publication Data

US 2009/0101442 A1 Apr. 23, 2009

(30) Foreign Application Priority Data

Dec. 14, 2004 (JP) ..... 2004-361177

(51) Int. Cl.
*F04B 17/00* (2006.01)

(52) U.S. Cl. ..... 417/415; 417/902

(58) Field of Classification Search ..... 417/415, 417/902, 368, 372; 418/94; 92/181 R, 172, 92/232–236; 184/6.16, 6.18
See application file for complete search history.

(56) References Cited

U.S. PATENT DOCUMENTS 1,408,066 A * 2/1922 Berry et al. ..... 92/236
1,772,931 A * 8/1930 Dusevoir ..... 92/158
1,815,733 A * 7/1931 Gulick ..... 92/236
2,046,789 A * 7/1936 Norton ..... 92/233
2,136,162 A * 11/1938 Ware ..... 92/233
2,147,956 A * 2/1939 Alexandrescu ..... 92/160
2,197,942 A * 4/1940 Over ..... 92/160
2,274,942 A * 3/1942 Touborg ..... 92/154
2,407,440 A * 9/1946 Osborne ..... 92/159
2,497,380 A * 2/1950 Venner et al. ..... 92/233
4,075,934 A * 2/1978 Wacker et al. ..... 92/159
4,599,935 A * 7/1986 Ellermann et al. ..... 92/159
4,756,241 A * 7/1988 Sakurahara et al. ..... 92/233
5,076,226 A * 12/1991 Watanabe et al. ..... 123/193.6
5,092,747 A * 3/1992 Irino ..... 417/312
5,195,478 A * 3/1993 Kawabata et al. ..... 123/193.4
5,816,134 A * 10/1998 Takenaka et al. ..... 92/159

(Continued)

FOREIGN PATENT DOCUMENTS

DE 11 22 209 B 1/1962

(Continued)

OTHER PUBLICATIONS

JP2003065236A Machine Translation,Horiguchi katamya ,2003.*

(Continued)

*Primary Examiner* — Devon C Kramer
*Assistant Examiner* — Amene Bayou
(74) *Attorney, Agent, or Firm* — RatnerPrestia

(57) ABSTRACT

The hermetic compressor has grooves provided at an upper side and a lower side of outer circumference of a piston. Of outer shape of the grooves, the outer shape of the grooves communicating with a space in the hermetic container at least when the piston is in a bottom dead center is a shape not forming parallel line to an axial center of the piston when the grooves are developed in a plane.

16 Claims, 5 Drawing Sheets

U.S. PATENT DOCUMENTS

| | | | | |
|---|---|---|---|---|
| 5,839,351 | A * | 11/1998 | Nakada | 92/160 |
| 6,431,053 | B1 * | 8/2002 | Strikis et al. | 92/158 |
| 2005/0265863 | A1 | 12/2005 | Akashi et al. | |

FOREIGN PATENT DOCUMENTS

| | | | |
|---|---|---|---|
| JP | 2003-065236 | A | 3/2003 |
| JP | 2003065236 | A * | 3/2003 |
| JP | 2004-027969 | A | 1/2004 |
| WO | WO 02/02944 | A | 1/2002 |
| WO | WO 2005/116450 | A | 12/2005 |

OTHER PUBLICATIONS

International Search Report for PCT/JP2005/023090, dated Feb. 16, 2006.

Japanese Office Action for 2004-361177, Oct. 26, 2010.

* cited by examiner

HERMETIC COMPRESSOR

This application is a U.S. National Phase Application of PCT International Application PCT/JP2005/023090.

TECHNICAL FIELD

The present invention relates to a hermetic compressor used in refrigeration cycle of freezer-refrigerator or the like.

BACKGROUND ART

A hermetic compressor used, for example, in household freezer-refrigerator is recently demanded to be lower in power consumption. A conventional hermetic compressor is improved in efficiency by modifying the outline shape of piston to reduce frictional loss between piston and cylinder. Such technology is disclosed, for example, in PCT International Publication WO02/02944A1.

This conventional hermetic compressor is described below while referring to the drawings.

FIG. 6 is a longitudinal sectional view of conventional hermetic compressor, and FIG. 7 is a perspective view of piston described in the publication used in the conventional hermetic compressor.

In FIG. 6 and FIG. 7, a motor element 4 and a compressor element 5 are accommodated in a hermetic container 1. The motor element 4 consists of a stator 2 having a winding 2*a*, and a rotor 3. The compressor element 4 is driven by the motor element 4. Oil 6 is stored in hermetic container 1.

A crank shaft 10 included in the compressor element 5 has a main shaft 11 mounting the rotor 3, and an eccentric shaft 12 formed eccentrically to the main shaft 11. Inside of the main shaft 11, an oil pump 13 is provided to be open in the oil 6. A block 20 has a cylindrical cylinder 21, and a bearing 22 for supporting the main shaft 11. The block 20 is disposed above the motor element 4. A piston 30 is inserted reciprocally and slidably in the cylinder 21 of the block 20, and is coupled to the eccentric shaft 12 by way of a linkage part 41.

As shown in FIG. 7, the piston 30 is composed of top surface 31, skirt surface 32, and outer circumference 33. The outer circumference 33 includes a seal surface 34, at least two guide surfaces 35, and removing part 36. The seal surface 34 is formed to contact tightly with the inner circumference of the cylinder 21. At least two guide surfaces 35 are formed to contact with part of the inner circumference of the cylinder 21, and is extended almost parallel to the moving direction of the piston 30. The removing part 36 does not contact with the inner circumference of the cylinder 21.

This prior art is characterized by that the angle formed by the line linking central axis 37 of cylindrical piston 30 and boundary edge 35*a* of guide surface 35 in radial direction of piston 30, and the line linking central shaft 37 and boundary edge 35*b* of guide surface 35 in radial direction of piston 30 is 40 degrees or less, or preferably 30 degrees or less.

In the conventional hermetic compressor having such configuration, the operation is explained below.

During operation of hermetic compressor, the piston 30 back and forth in the cylinder 21. When the piston 30 is in a bottom dead center, part of skirt side of the piston 30 protrudes from the cylinder 21. When the piston 30 gets into the cylinder 21, it is guided by the guide surface 35 and smoothly moves into the cylinder 21. The sliding surface formed by the inner circumference of cylinder 21 and outer circumference of piston 30 is decreased by the removing part 36 of piston 30 and is hence reduced in sliding resistance, so that the sliding loss can be decreased.

When moving from the bottom dead center to a top dead center in compression stroke, the top surface 31 of piston 30 receives compressive load of refrigeration gas. At this time, the crank shaft 10 is pushed by force toward the anti-piston direction by way of the connecting rod 41, and the crank shaft 10 is bented. As a result, a strong force acts to incline the piston 30 in vertical direction.

In the conventional configuration, however, inclination of piston 30 on cylinder 21 in vertical direction is regurated only by the small interval from the edge of top surface 31 of piston 30 to edge of seal surface 34, and by a gap of outer circumference 33 of piston 30 and cylinder 21. Accordingly, the piston 30 is inclined largely, and the amount of refrigerant gas leaking from the top dead center to the bottom dead center of piston 30 is increased through the gap expanded by increase of slope angle of pistons. As a result, the refrigeration capacity of hermetic compressor is lowered.

Along with increase of slope angle of piston, surface pressure increases in boundary edges 35*a*, 35*b* of guide surface 35 of piston 30, and local wear is likely to occur. As a result, the reliability as hermetic compressor is lowered, and the efficiency is also lowered.

These problems are particularly manifest when R600a is used as refrigerant because, generally, the outside diameter of piston 30 is larger, and the refrigerant is likely to leak out. Hence, in the hermetic compressor using R600a as refrigerant, efficiency is lowered significantly.

DISCLOSURE OF THE INVENTION

A hermetic compressor of the invention stores oil in a hermetic container and accommodates a compression mechanism for compressing refrigerant gas.

The compression mechanism is disposed in vertical direction, and comprises a crank shaft having a main shaft and a eccentric shaft, a block forming a cylinder, a piston making a reciprocating motion in the cylinder, and having a top surface and a skirt surface vertical to a direction of the reciprocating motion, a connecting rod for coupling the eccentric shaft and the piston, and an oil supply system for supplying the oil to an outer circumference of the piston.

Grooves are provided at an upper side and a lower side of the outer circumference of the piston. Of an outer shape of the grooves, the outer shape of the grooves communicating with a space in the hermetic container at least when the piston is in the bottom dead center is a shape not forming a parallel line to an axial center of the piston when the grooves are developed in a plane.

By this configuration, a high efficiency is achieved by reduction of frictional loss by decrease of contact area. The piston is less likely to incline in vertical direction to the cylinder, and leak of refrigerant is suppressed, and decline of volume efficiency is prevented. Moreover, lateral pressure load to sliding parts when the piston is inclined is decreased and local wear can be decreased. As a result, hermetic compressor of high reliability, large refrigerating capacity and high efficiency is presented.

The hermetic compressor of the invention may be also composed as follows.

The hermetic compressor stores oil in a hermetic container and accommodates a compression mechanism for compressing refrigerant gas.

The compression mechanism is disposed in vertical direction, and comprises a crank shaft having a main shaft and a eccentric shaft, a block forming a cylinder, a piston making a reciprocating motion in the cylinder, and having a top surface and a skirt surface vertical to a direction of the reciprocating motion, a connecting rod for coupling the eccentric shaft and the piston, and an oil supply system for supplying the oil to an outer circumference of the piston.

Grooves are provided at an upper side and a lower side of the outer circumference of the piston. The grooves include a first groove portion extending toward the skirt side of the piston, and a second groove portion extending toward the top side of the piston, and the outer shape of the first groove portion is curved, and the first groove portion communicates with a space in the hermetic container at least when the piston is in the bottom dead center.

DETAILED DESCRIPTION OF THE PREFERRED EMBODIMENTS

Preferred embodiments of the invention are specifically described below while referring to the accompanying drawings. It must be noted, however, that the invention is not limited to the preferred embodiments alone.

Figure 1:
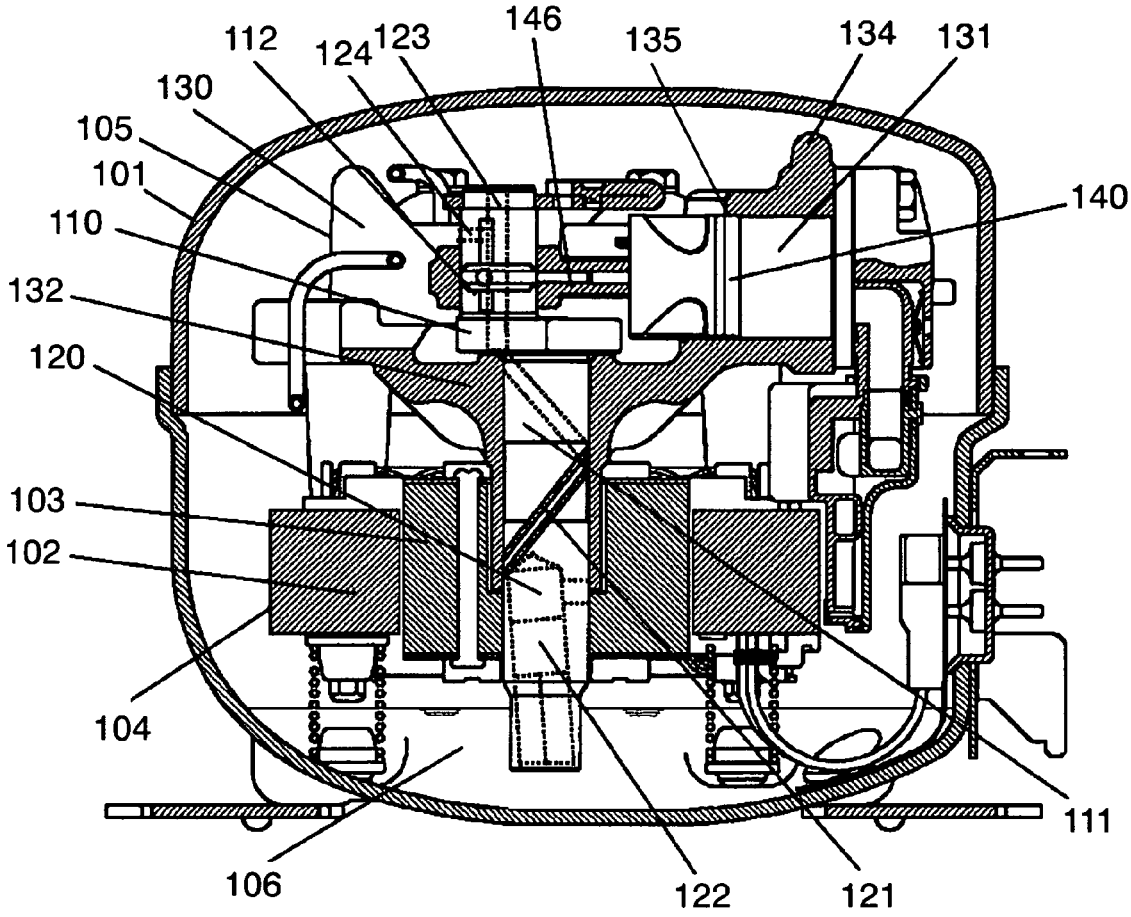
FIG. 1 is a longitudinal sectional view of hermetic compressor in a preferred embodiment of the invention.
Figure 2:
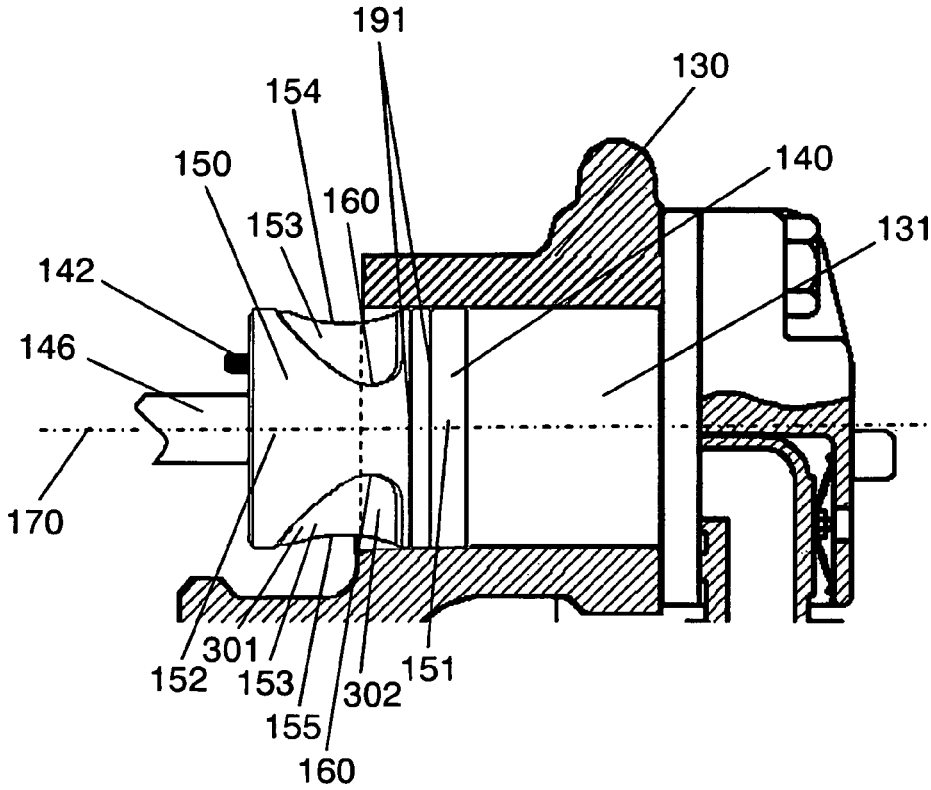
FIG. 2 is a magnified view of elements around piston used in the hermetic compressor in FIG. 1.
Figure 3:
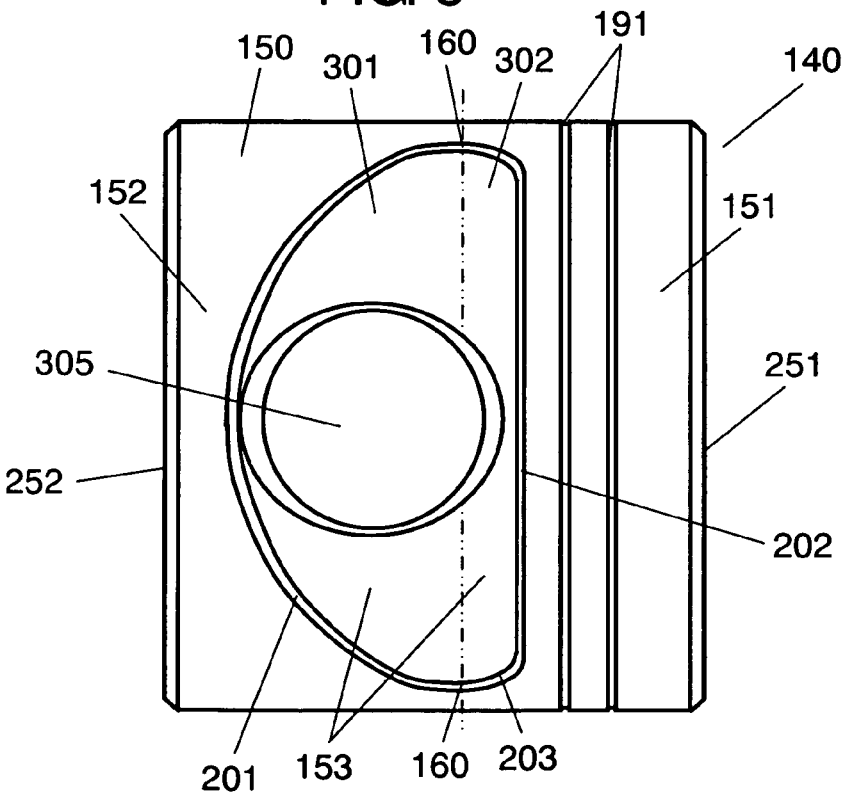
FIG. 3 is a top view of piston used in the hermetic compressor in FIG. 1.
Figure 4:
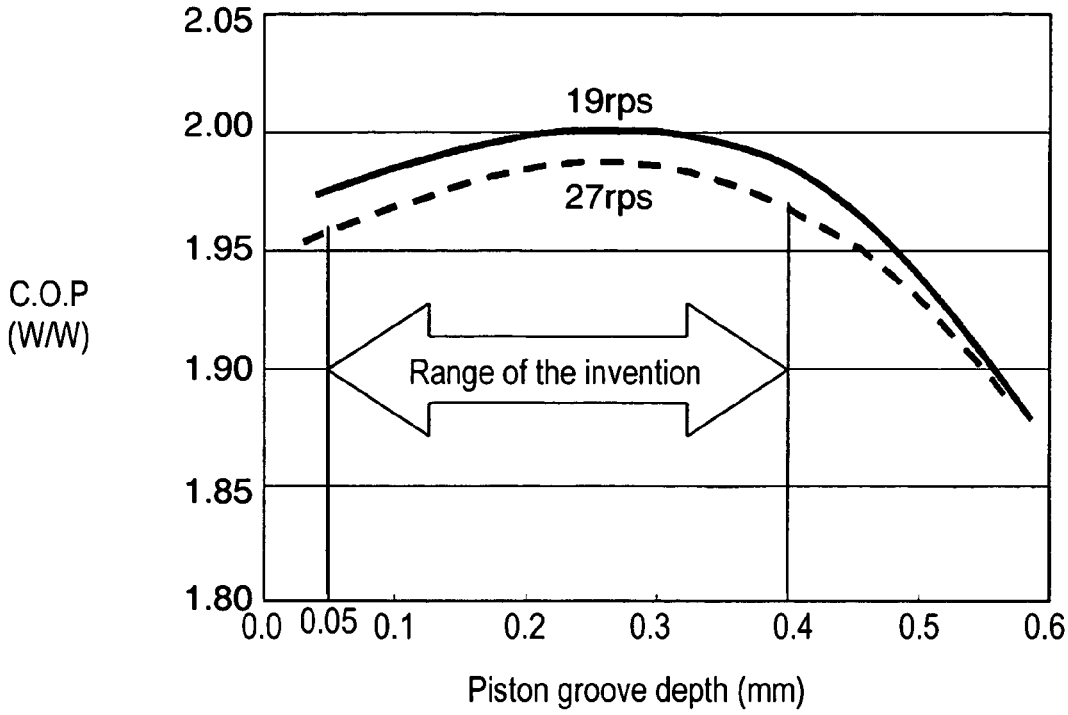
FIG. 4 is a characteristic diagram of groove depth and coefficient of performance of piston used in the hermetic compressor in FIG. 1.
Figure 5:
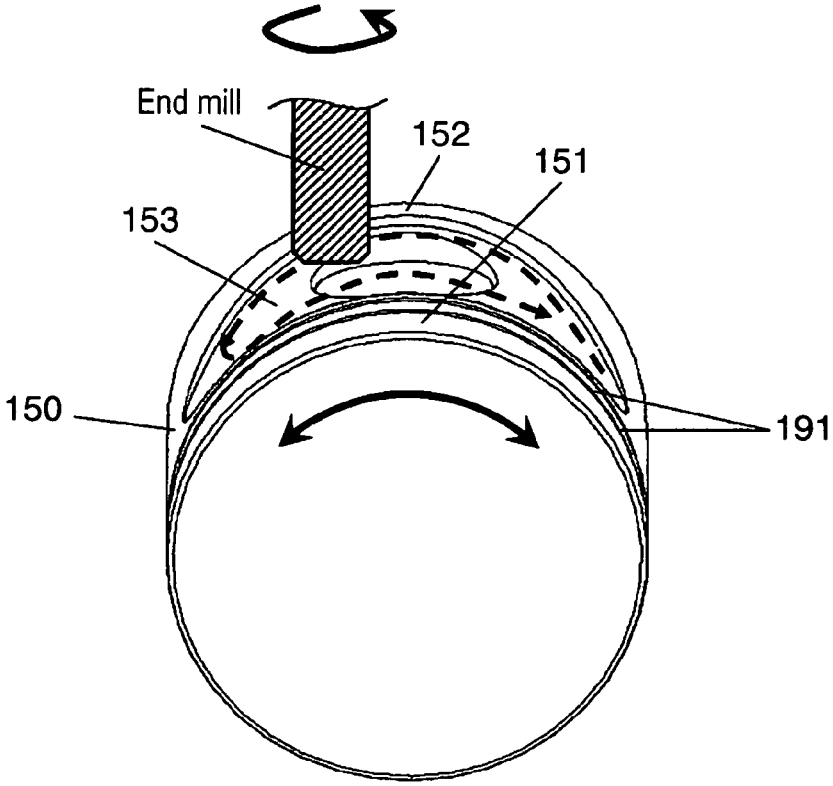
FIG. 5 is a schematic diagram showing groove processing method of piston used in the hermetic compressor in FIG. 1.
Figure 6:
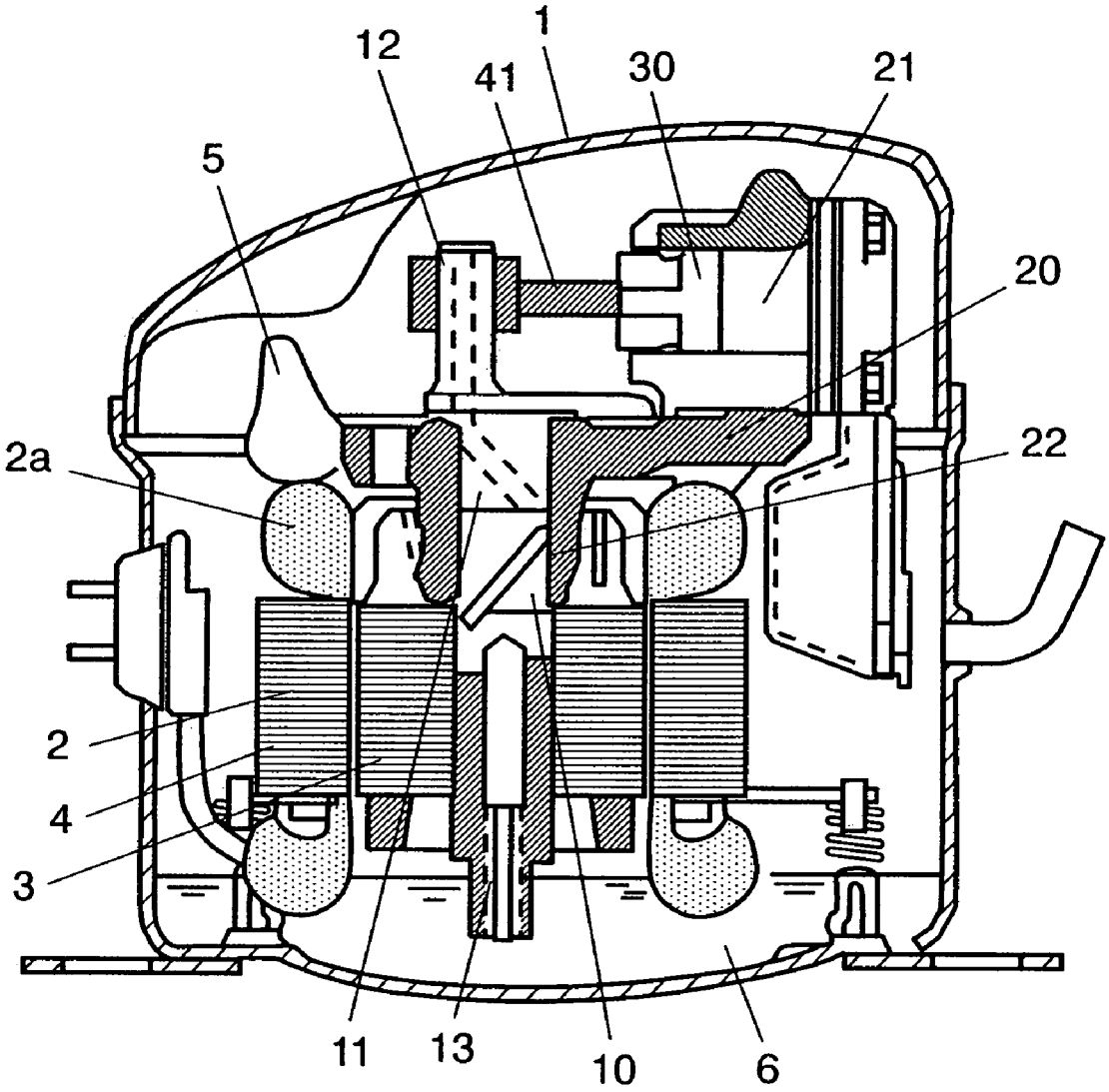
FIG. 6 PRIOR ART
FIG. 6 is a longitudinal sectional view of conventional hermetic compressor.
Figure 7:
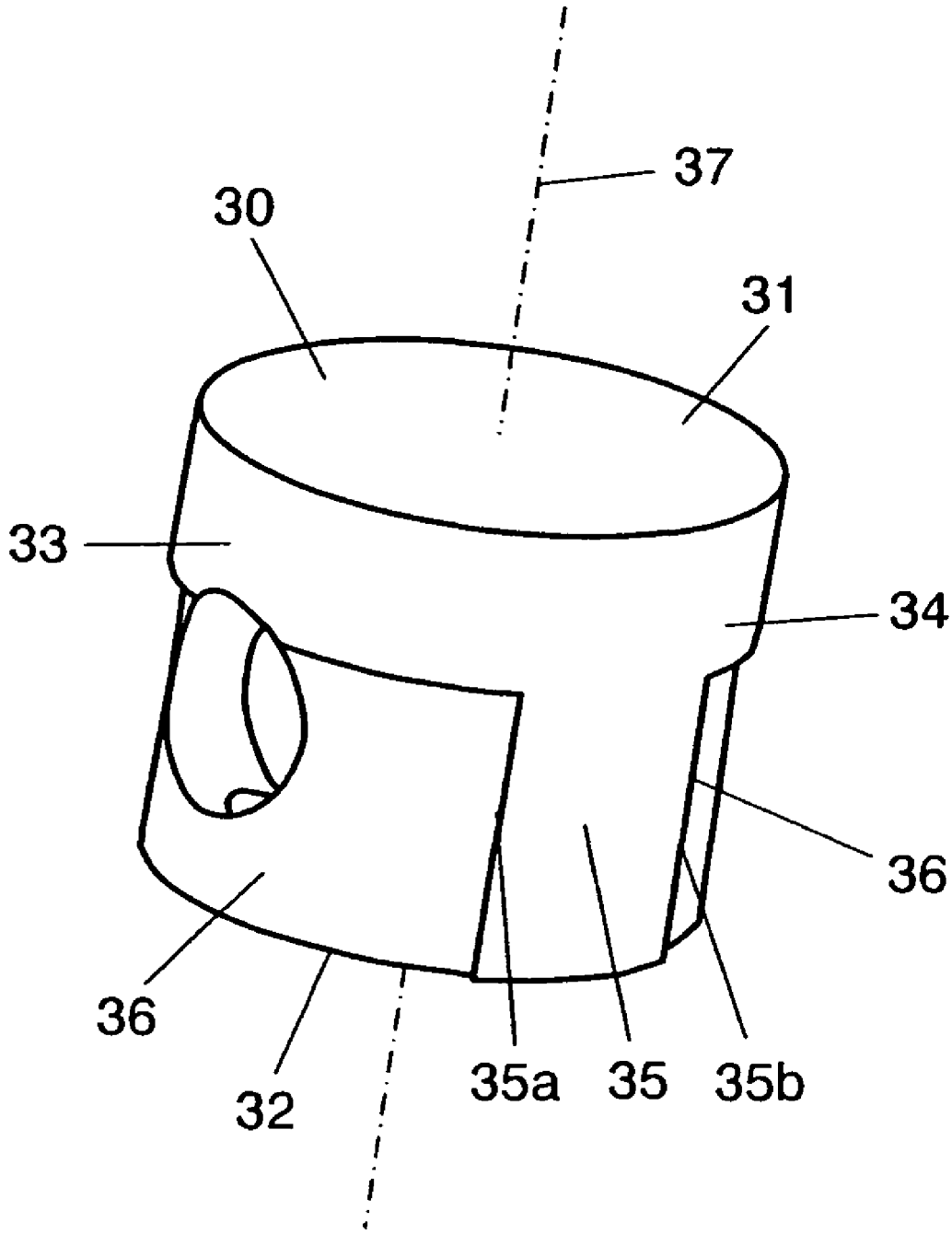
FIG. 7 PRIOR ART
FIG. 7 is a perspective view of piston used in the conventional hermetic compressor.

FIG. 1 is a longitudinal sectional view of hermetic compressor in a preferred of the invention, FIG. 2 is a magnified view of elements around piston used in the hermetic compressor in FIG. 1, FIG. 3 is a top view of piston used in the hermetic compressor in FIG. 1, and FIG. 4 is a characteristic diagram of groove depth and coefficient of performance of piston used in the hermetic compressor in FIG. 1. In FIG. 4, the axis of abscissas denotes the groove depth of piston, and the axis of ordinates represents the coefficient of performance (C.O.P.). FIG. 5 is a schematic diagram showing groove processing method of piston used in the hermetic compressor in FIG. 1.

In FIG. 1 to FIG. 3, the hermetic compressor of the preferred embodiment of the invention stores oil 106 and accommodates a compression mechanism 105 for compressing refrigerant gas in a hermetic container 101.

The compression mechanism 105 comprises a crank shaft 110 having main shaft 111 and eccentric shaft 112 disposed in vertical direction, a block 130 forming a cylinder 131, a piston 140 moving reciprocally in the cylinder 131 and having top surface 251 and skirt surface 252 vertical to reciprocal direction, a connecting rod 146 for coupling the eccentric shaft 112 and piston 140, and an oil supply system 120 for supplying oil 106 to outer circumference 150 of piston 140.

Grooves 153 are provided at the upper side 154 and lower side 155 of outer circumference of piston 140. Of the outer shape of grooves 153, at least the outer shape of groove 153 communicating with the space in the hermetic container 101 when the piston 140 is in a bottom dead center is a shape not forming parallel line to axial center 170 of piston 140 when the groove 153 is developed in a plane.

Or, outer shape of all grooves 153 may be formed in a shape not forming parallel line to axial center of piston 140 when grooves 153 are developed in a plane.

Depth of grooves 153 from outer circumference 150 of piston 140 is preferably 50 μm or more to 400 μm or less.

Outer shape of grooves 153 is preferably as follows. That is, the outer shape of groove 153 is a semicircular shape extending toward the side of the skirt side 152 of piston 140, and this semicircular shape includes a first outer shape 201 extending toward the side of skirt side 152 of piston 140, a second outer shape 202 parallel to the top surface 251 of piston 140, and a third outer shape 203 linking the first outer shape 201 and second outer shape 202, and the curvature of first outer shape 201 is smaller than the curvature of third outer shape 203.

The preferred embodiment is particularly effective when gas of hydrocarbon refrigerant is used as refrigerant gas.

The groove 153 is further described below by referring to a different example.

The groove 153 has a first groove portion 301 extending toward the side of skirt side 152 of piston 140, and a second groove portion 302 extending toward the side of top side 151 of piston 140.

The outer shape of first groove portion 301 is curved, and the first groove portion 301 communicates at least with the space in the hermetic container 101 when the piston 140 is in the bottom dead center.

The meaning that the outer shape of first groove portion 301 is curved is that the outer shape of groove 153 at least communicating with the space in the hermetic container 101 when the piston 140 is in the bottom dead center, out of the outer shape of the groove 153, is a shape not forming parallel line to axial center 170 of piston 140 when the groove 153 is developed in a plane.

The curve of outer shape of first groove portion 301 may be an arc such as first outer shape 201 shown in FIG. 3, or a bent curve. The curve may partly include a straight portion, as far as the straight portion does not form parallel line to axial center 170 of piston 140.

This is a characteristic feature of hermetic compressor of the preferred embodiment, and the configuration is more specifically described below by referring to FIG. 1 to FIG. 3.

The hermetic compressor of the preferred embodiment accommodates a motor element 104 and a compression mechanism 105 in a hermetic container 101. The motor element 104 includes a stator 102 and a rotor 103. The motor element 104 is driven by inverter at plural operating frequencies including an operating frequency lower than power source frequency. The compression mechanism 105 is driven by motor element 104. Oil 106 is stored in hermetic container 101.

The refrigerant used in the hermetic compressor is hydrocarbon refrigerant R600a which is a natural refrigerant low in warming coefficient.

The crank shaft 110 has a main shaft 111 mounting the rotor 103, and an eccentric shaft 112 formed eccentrically to the main shaft 111, being disposed nearly in vertical direction.

The oil supply system 120 is composed of centrifugal pump 122, viscous pump 121, longitudinal hole 123, and lateral hole 124. The centrifugal pump 122 has one end opened into the oil 106, and other end communicating with one end of viscous pump 121. The centrifugal pump 122 is formed inside of the crank shaft 110. Other end of viscous pump 121 communicates with longitudinal hole 123. The longitudinal hole 123 communicates with the lateral hole 124. The longitudinal hole 123 and lateral hole 124 is opened to the space in the hermetic container 101.

The block 130 forms a nearly cylindrical cylinder 131, and has a main bearing 132 for supporting the main shaft 111. A warped contact part 134 is formed in the upper part of the cylinder 131.

The piston 140 is inserted reciprocally and slidably in the cylinder 131 of the block 130. The piston 140 is coupled to the eccentric shaft 112 of the crank shaft 110 by way of connecting rod 146 which is connecting rod. As shown in FIG. 2, when the piston 140 is in the bottom dead center, part of the skirt side of the piston 140 protrudes from the cylinder 131.

On the outer circumference 150 of piston, grooves 153 are formed at the upper side 154 and lower side 155 of outer circumference. Both grooves 153 communicate with the space in the hermetic container 101 at least when the piston 140 is in the bottom dead center. However, the both grooves 153 are not extended to the top side 151 and skirt side 152 of piston 140.

Of outer shapes of grooves 153, at least the outer shape of the groove 153 communicating with the space inside the hermetic container 101 when the piston 140 is in the bottom dead center is a shape not forming parallel line to the axial center 170 of piston 140 when the groove 153 is developed in a plane.

Referring now to FIG. 3, the shape of groove 153 is more specifically described. FIG. 3 is an explanatory diagram seeing from the top of piston 140.

The outer shape of groove 153 is a semicircular shape extending toward the side of the skirt side 152 of piston 140. This semicircular shape includes a first outer shape 201 extending toward the side of skirt side 152 of piston 140, a second outer shape 202 parallel to the top surface 251 of piston 140, and a third outer shape 203 linking the first outer shape 201 and second outer shape 202, and the curvature of first outer shape 201 is smaller than the curvature of third outer shape 203.

In other words, the groove 153 includes a first groove portion 301 extending to the side of skirt side 152 of piston 140 at the left side of the boundary of imaginary line (double dot chain line) linking the upper and lower borders 160 in FIG. 3, and a second groove portion 302 extending to the side of top side 151 of piston 140 at the right side. The groove 153 has a concave shape enclosed by first outer shape 201 of first groove portion 301, second outer shape 202 of second groove portion 302, and third outer portion 203 of second groove portion 302.

The outer shape of the first groove portion 301, that is, the first outer shape 201 is curved, and, as shown in FIG. 2, at least the first groove portion 301 communicates with the space in the hermetic container 101 when the piston 140 is in the bottom dead center.

A through-hole 305 is provided nearly in the center of the groove 153.

Curvature of first outer shape 201 of first groove portion 301 extending toward the side of skirt side 152 of piston 140 is formed smaller than curvature of third outer shape 203 of second groove portion 302 extending toward the side of top side 151 of piston 140.

Depth of groove 153 from outer circumference 150 of piston is 50 μm or more to 400 μm or less. Accordingly, the end mill for processing the groove 153 can form the groove 153 by turning around the piston by one revolution as shown in FIG. 5. The total area of grooves 153 is composed so as to be larger than the area of piston outer circumference 150 excluding the grooves 153.

As shown in FIG. 2, plural annular grooves 191 is formed near the side of top side 151 of outer circumference of piston 140.

In the hermetic compressor thus composed, the action and operation are explained below.

The rotor 103 of the motor element 104 rotates the crank shaft 110. Rotary motion of eccentric shaft 112 of crank shaft 110 is transmitted to piston 140 by way of connecting rod 146 and piston pin 142, and the piston 140 moves reciprocally in the cylinder 131. As a result, the refrigerant gas is sucked into the cylinder 131 from the cooling system (not shown) and compressed, and discharged again into the cooling system.

On the other hand, the oil supply system 120 elevates the oil 106 by centrifugal pump 122 by centrifugal force generated by rotation of centrifugal pump 122 along with rotation of crank shaft 110. The oil 106 reaching the viscous pump 121 is elevated within the viscous pump 121, and sprinkled into the hermetic container 101 from the longitudinal hole 123 and lateral hole 124. The sprinkled oil 106 hits against the contact part 134, and sticks to the outer circumference 150 of piston by way of notch 135. Sticking oil 106 invades into outer circumference 150 of piston, groove 153, and annular groove 191 along with reciprocal motion of piston 140, and lubricates between the outer circumference 150 of piston and cylinder 131.

At this time, in the preferred embodiment, as shown in FIG. 1 and FIG. 2, part of the skirt side of piston 140 is designed to protrude from the cylinder 131 when the piston 140 is in the bottom dead center. As a result, when the piston 140 comes to the bottom dead center, the groove 153 protrudes out of the cylinder 131 and receives oil 106, so that oil 106 is sufficiently supplied into the groove 153.

The shape of the groove 153 when developed in a plane is a curved shape to be gradually increased in sliding width toward the skirt direction of piston 140 so as not to form parallel line to axial center 170 of piston 140. By this configuration, the oil 106 getting into the groove 153 is stored near the upper part of the groove 153. The stored oil 106 is sent into the inner side of the cylinder 131 when the piston 140 moves from the bottom dead center to a top dead center. The oil 106 is further attracted into the gap between the cylinder 131 and outer circumference 150 of piston when the piston 140 moves from the top dead center to the bottom dead center along with motion of the piston 140, and thereby lubricates the area near the sliding parts of the top effectively.

By this action, a sufficient oil film is formed between the cylinder 131 and outer circumference 150 of piston, and an extremely high sealing performance is obtained. As a result, the hermetic compressor of the embodiment is enhanced in volume efficiency, and is hence enhanced in refrigerating capacity.

Since the shape of the groove 153 developed in a plane does not form parallel line to axial center 170 of piston 140, and it is effective to prevent local wear such as stepped wear in reciprocal motion direction occurring when parallel line to axial center of piston is formed, and together with improved lubricity, an extremely high reliability is obtained.

When the piston 140 is in the top dead center, the inside of the cylinder 131 is at high pressure because of compressed refrigerant, and refrigerant tends to escape from the gap between the cylinder 131 and outer circumference 150 of piston. At this time, by the compressive load occurring in the cylinder 131, the crank shaft 110 is pushed in the direction of the bottom dead center by way of piston pin 142 and connecting rod 146, and is bented largely in the vertical direction, and the piston 140 is inclined in vertical direction to the cylinder 131.

In this preferred embodiment, however, since the shape forming the piston groove 153 is formed in curvature increasing in the sliding width toward the skirt direction of piston 140, and is held widely in inclining direction, so that large inclination of piston 140 can be prevented.

As a result, leak of refrigerant from the cylinder 131 into the hermetic container 101 is suppressed, and lateral pressure load to the sliding parts when inclining is decreased, and local wear is prevented, and the reliability of sliding parts is enhanced.

FIG. 4 shows the characteristic of groove depth and coefficient of performance COP (W/W) of compressor of the preferred embodiment, using R600a as refrigerant. In the diagram, 19 rps and 27 rps refer to rotating speed of crank shaft.

As clear from this result, since the depth of groove 153 from outer circumference of piston is 50 μm or more to 400 μm or less, in low speed operation of high power saving effect of refrigerator, aside from sliding loss reducing effect by viscous resistance, sealing effect for preventing leak of refrigerant gas is enhanced, and higher efficiency is obtained.

If the depth of groove 153 exceeds 400 μm, the coefficient of performance is lowered because it is estimated that the oil stored in the groove 153 is less likely to distribute around the piston 140 when the groove 153 is too deep, thereby impairing the sealing performance. On the other hand, the lower limit is about 50 μm from the viewpoint of management of process.

In FIG. 3 and FIG. 5, the shape of groove 153 is a semicircular shape extending toward the side of the skirt side 152 of piston 140. The curvature of first outer shape 201 of first groove portion 301 extending toward the side of skirt side 152 of piston 140 is smaller than the curvature of third outer shape 203 of second groove portion 302 extending toward the side of top side 151 of piston 140. As shown in FIG. 5, the end mill turns around the groove 153 by one reciprocal motion around the axial center of the piston 140, and the groove 153 is formed. Therefore, it is not necessary to move the same processing track plural times, and the groove is formed in a short time, and the production time is shortened, and the productivity is enhanced.

Density of refrigerant R600a is smaller than that of refrigerant R134a conventionally used in refrigerator, and in order to obtain same refrigerating capacity as the hermetic compressor using refrigerant R134a by using refrigerant R600a, generally, the cylinder volume is increased, and the outside diameter of piston 140 becomes large. Therefore, the refrigerant leaking into the hermetic container 101 from the cylinder 131 is increased because the passage area is increased. In the piston 140 of the preferred embodiment, however, since inclination to cylinder 131 is smaller, the efficiency is further enhanced.

In a structure of forming a sub-shaft on the crank shaft 110 coaxially with main shaft 111 across the eccentric shaft 112, since the eccentric shaft is supported at both ends, the crank shaft 110 is hardly inclined. As a result, the piston 140 is less likely to incline in vertical direction toward the cylinder 131, and the behavior of piston 140 is stabilized, and sliding loss is decreased, increase of noise is suppressed, and high efficiency and low noise can be realized.

INDUSTRIAL APPLICABILITY

The hermetic compressor of the invention is decreased in sliding loss of piston outer circumference and enhanced in oil holding property, and is enhanced in efficiency. Further, inclination in piston sliding motion is suppressed, and reliability of sliding parts is improved. Therefore, the hermetic compressor can be applied widely including air conditioner and automatic vending machine.

The invention claimed is:

1. A hermetic compressor storing oil in a hermetic container and accommodating a compression mechanism for compressing refrigerant gas, wherein the compression mechanism comprises:

a crank shaft disposed in vertical direction, and having a main shaft and an eccentric shaft, a block forming a cylinder, a piston making a reciprocating motion in the cylinder, and having a top surface and a skirt surface, both vertical to a direction of the reciprocating motion, a connecting rod for coupling the eccentric shaft and the piston, and an oil supply system for supplying the oil to an outer circumference of the piston, grooves are provided at an upper side and a lower side of the outer circumference of the piston, and an outer shape of the grooves communicating with a space in the hermetic container at least when the piston is in a bottom dead center is a shape not forming a parallel line to an axial center of the piston when the grooves are developed in a plane, wherein the outer shape of the grooves is a closed semicircular shape extending toward a skirt side of the piston, and the semicircular shape includes a first outer shape extending toward the skirt side of the piston, a second outer shape parallel to the top surface of the piston, and a third outer shape linking the first outer shape and the second outer shape, and a curvature of the first outer shape is smaller than that of the third outer shape, a width of the grooves being greater at an upper portion thereof, and the groove enclosed by the first outer shape communicates at least with the space in the hermetic container when the piston is in the bottom dead center.

2. The hermetic compressor of claim 1, wherein all of the outer shape of the grooves are shapes not forming a parallel line to the axial center of the piston when the grooves are developed in a plane.

3. The hermetic compressor of claim 1, wherein a depth of the grooves from the outer circumference of the piston is not smaller than 50 μm but not greater than 400 μm.

4. The hermetic compressor of claim 1, wherein the refrigerant gas is gas of hydrocarbon refrigerant.

5. The hermetic compressor of claim 1, wherein the outer shape of the groove including the first outer shape, the second outer shape, and the third outer shape is a curved shape to be gradually increased in sliding width toward the skirt direction of the piston.

6. The hermetic compressor of claim 5, wherein the third outer shape links the first outer shape and the second outer shape, the first groove portion and the second groove portion is separated by a boundary line which passes through middles of the third outer shapes, and an axial length of the first groove portion is larger than an axial length of the second groove portion.

7. The hermetic compressor of claim 1, wherein a through-hole is disposed at about the center of the grooves.

8. The hermetic compressor of claim 1, wherein the second outer shape has a length greater than a radius of the piston.

9. The hermetic compressor of claim 1, wherein the first outer shape is inverted with respect to the second outer shape.

10. A hermetic compressor storing oil in a hermetic container and accommodating a compression mechanism for compressing refrigerant gas, wherein the compression mechanism comprises:

a crank shaft disposed in vertical direction, and having a main shaft and a eccentric shaft, a block forming a cylinder, a piston making a reciprocating motion in the cylinder, and having a top surface and a skirt surface, both vertical to a direction of the reciprocating motion, a connecting rod for coupling the eccentric shaft and the piston, and an oil supply system for supplying the oil to an outer circumference of the piston, grooves are provided at an upper side and a lower side of the outer circumference of the piston, the grooves include a first groove portion extending toward a skirt side of the piston, and a second groove portion extending toward a top side of the piston, said first and second groove portions having a closed semicircular shape, and the outer shape of the first groove portion is curved, a width of the first groove portion being greater at an upper portion thereof, and the first groove portion communicates with a space in the hermetic container at least when the piston is in a bottom dead center.

11. The hermetic compressor of claim 10, wherein the outer shape of the first groove portion is a curved shape to be gradually increased in sliding width toward the skirt direction of the piston.

12. The hermetic compressor of claim 10, wherein a through-hole is disposed at about the center of the grooves.

13. The hermetic compressor of claim 10, wherein the first groove portion and the second groove portion are separated by a boundary line which passes through a widest portion of the grooves in a circumferential direction and an axial length of the first groove portion is larger than an axial length of the second groove portion.

14. A hermetic compressor storing oil in a hermetic container and accommodating a compression mechanism for compressing refrigerant gas, wherein the compression mechanism comprises:

a crank shaft disposed in vertical direction, and having a main shaft and an eccentric shaft, a block forming a cylinder, a piston making a reciprocating motion in the cylinder, and having i) a top surface and a skirt surface, both vertical to a direction of the reciprocating motion and ii) a through-hole, a connecting rod for coupling the eccentric shaft and the piston at the through-hole of the piston, and an oil supply system for supplying the oil to an outer circumference of the piston, grooves are provided at an upper side and a lower side of the outer circumference of the piston and disposed around the through-hole, and an outer shape of the grooves communicating with a space in the hermetic container at least when the piston is in a bottom dead center is a shape not forming a parallel line to an axial center of the piston when the grooves are developed in a plane, wherein the outer shape of the grooves is a contiguous semicircular shape extending toward a skirt side of the piston, and the semicircular shape includes a first outer shape extending toward the skirt side of the piston, a second outer shape parallel to the top surface of the piston, and a third outer shape linking the first outer shape and the second outer shape, and a curvature of the first outer shape is smaller than that of the third outer shape, a width of the grooves being greater at an upper portion thereof, and the groove enclosed by the first outer shape communicates at least with the space in the hermetic container when the piston is in the bottom dead center.

15. The hermetic compressor of claim 14, wherein the second outer shape has a length greater than a radius of the piston.

16. A hermetic compressor storing oil in a hermetic container and accommodating a compression mechanism for compressing refrigerant gas, wherein the compression mechanism comprises:

a crank shaft disposed in vertical direction, and having a main shaft and an eccentric shaft, a block forming a cylinder, a piston making a reciprocating motion in the cylinder, and having a top surface and a skirt surface, both vertical to a direction of the reciprocating motion, a connecting rod for coupling the eccentric shaft and the piston, and an oil supply system for supplying the oil to an outer circumference of the piston, grooves are provided at an upper side and a lower side of the outer circumference of the piston, a sliding surface is provided all around a skirt side of the piston, and an outer shape of the grooves communicating with a space in the hermetic container at least when the piston is in a bottom dead center is a shape not forming a parallel line to an axial center of the piston when the grooves are developed in a plane, wherein the outer shape of the grooves is a closed semicircular shape extending toward the skirt side of the piston, and the semicircular shape includes a first outer shape extending toward the skirt side of the piston, a second outer shape parallel to the top surface of the piston, and a third outer shape linking the first outer shape and the second outer shape, and a curvature of the first outer shape is smaller than that of the third outer shape, a width of the grooves being greater at an upper portion thereof, and the groove enclosed by the first outer shape communicates at least with the space in the hermetic container when the piston is in the bottom dead center.

* * * * *